US006177139B1

(12) United States Patent
Rouvelin

(10) Patent No.: US 6,177,139 B1
(45) **Date of Patent: *Jan. 23, 2001**

(54) PAINT SPRAY BOOTH CONTROLLER

(75) Inventor: Thierry Rouvelin, Goodrich, MI (US)

(73) Assignee: Behr Systems, Rochester Hills, MI (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

This patent is subject to a terminal disclaimer.

(21) Appl. No.: 09/160,111

(22) Filed: Sep. 24, 1998

Related U.S. Application Data

(62) Division of application No. 08/867,607, filed on Jun. 2, 1997, now Pat. No. 5,868,845, which is a continuation of application No. 08/490,058, filed on Jun. 13, 1995, now Pat. No. 5,656,089.

(51) Int. Cl.[7] ..... B05D 1/02; B05C 11/00

(52) U.S. Cl. ..... 427/421; 427/8; 118/663; 239/DIG. 14

(58) Field of Search ..... 427/421, 8; 118/663, 118/323, 696, 704, 309, 305, 313, 315; 239/751, 752, DIG. 14, 207, 209

(56) References Cited

U.S. PATENT DOCUMENTS

| | | | |
|---|---|---|---|
| 4,660,771 | 4/1987 | Chabert et al. . | |
| 4,878,454 | 11/1989 | Cann . | |
| 5,266,115 | 11/1993 | Taccoon et al. . | |
| 5,656,089 | 8/1997 | Rouvelin . | |
| 5,689,415 | 11/1997 | Calotychos et al. . | |
| 5,868,845 * | 2/1999 | Rouvelin | 118/663 |

FOREIGN PATENT DOCUMENTS 0618013 3/1994 (EP) .

* cited by examiner

*Primary Examiner*—Laura Edwards
(74) *Attorney, Agent, or Firm*—Howard & Howard

(57) ABSTRACT

A paint spray apparatus includes a plurality of paint sprayers installed in a paint spray booth. Each paint sprayer includes a paint spray head pivotably mounted on the end of a movable paint spray arm. The paint spray arm and paint spray head are movable on multiple axes by servo motors, which are controlled by servo drives mounted on or beside the paint sprayer. The spray of the paint spray head is controlled by a plurality of proportional solenoid valves mounted on the paint sprayer. The movement and spray of the paint sprayers are controlled by a computer having an interface to an optical fiber. The optical fiber connects the computer to the servo drives in series in a token ring network.

23 Claims, 3 Drawing Sheets

PAINT SPRAY BOOTH CONTROLLER

This is a divisional of U.S. Ser. No. 08/867,607 now U.S. Pat. No. 5,868,845, which is a continuation of U.S. Ser. No. 08/490,058, now U.S. Pat. No. 5,656,089.

BACKGROUND OF THE INVENTION

The present invention relates to a paint spray booth and more particularly to a system for controlling a plurality of paint sprayers operating within the paint spray booth.

A paint spray apparatus for painting a succession of articles, for example vehicle bodies, generally includes a paint spray booth installed in a clean room. The paint spray booth includes a plurality of paint sprayers having paint spray heads such as rotary bell atomizers mounted on the end of a paint spray arm. Typical paint sprayers have up to nine axes and a corresponding number of servo motors. For example, a four-axis paint sprayer includes four servo motors for moving the paint spray arm vertically, extending the paint spray arm horizontally, tilting the paint spray head on the end of the paint spray arm, and driving a pump to supply paint to the paint spray head. Each of the servo motors in each of the paint sprayers is controlled by a servo drive mounted in a motion panel located outside the clean room.

An operater enters information, such as the model of the vehicle body and color to be painted, into a computer controller outside the clean room. This information is sent to one or more motion cards. For the rest of the painting cycle (one vehicle body), the motion cards send signals to each servo drive indicating desired rates and directions of motion for each axis. Cables connect the motion card to IDC connectors mounted on the motion panel. Another set of cables connect the IDC connectors to each of the servo drives. Yet another set of cables from the servo drives to the IDC connectors to the motion card provide feedback from the servo drives to the controller.

Each of these servo drives provides a control signal to its corresponding motor through a plurality of wires connected to plugs mounted on the motion panel. From the motion panel, cables connect to plugs mounted on an explosion-proof box on the paint sprayer. The length of these cables, up to 50 meters, will vary for each sprayer because each sprayer is a different distance from the motion panel. Similarly, feedback signals from the motor pass through the explosion-proof box to another set of plugs, where cables of varying length up to 50 meters carry the signals to the plugs mounted on the motion panel, where a plurality of wires carry the feedback signals to the servo drive.

For each axis of each paint sprayer, three limit switches are typically used to provide additional feedback to the computer. The limit switches indicate overtravel in each direction on each axis and indicate a "home" position on that axis. The signals from the limit switches are carried to a junction box mounted on each paint sprayer. Cables connect plugs on a junction box on each paint sprayer to plugs mounted on the motion panel. In the motion panel, intrinsic safety barriers are connected between the plugs on the motion panel and IDC connectors. Ribbon cables carry the feedback signal from the IDC connectors to the motion card.

Each paint sprayer further includes a plurality of transducers for controlling functionality of the bell paint spray head. The transducers are mounted in a transducer panel on or near each paint sprayer. A first transducer controls the shape of the spray from the rotary bell paint spray head. A second transducer controls the rotation speed of the of the rotary bell paint spray head. A third transducer controls the supply of paint to the paint spray head. A dispatcher in each transducer panel receives a control signal from the computer along a cable up to 50 meters in length. The dispatcher then sends a control signal to each of the transducers. However, these transducers and dispatchers are expensive.

In the known system, the installation time and cost are greatly increased by the need to size and connect numerous wires, cables, plugs and connectors. Cables between the motion panel and each sprayer must be individually sized because each sprayer is a different distance from the motion panel and computer. The paint is potentially explosive and each connection point for each wire provides a possible source of a spark. Further, each connection between the computer and the sprayers is a potential failure point. The high number of wires and connections in the known system increases the likelihood of failure and spark and increases the difficulty in diagnosing failures. Additionally, current signals through the wires and cables generate electromagnetic fields that may cause electromagnetic interference problems with other nearby electronic devices.

SUMMARY OF THE INVENTION

The present invention provides a paint spray apparatus for painting a succession of articles that is less expensive, easier to install and more reliable. At installation only an optical fiber need be connected to each of the paint sprayers and to the computer controller. The amount of wire and connectors is greatly decreased, thereby decreasing the cost and increasing the reliability of the paint spray apparatus. Further, the optical fiber does not carry electrical current and therefore does not generate electromagnetic fields which interfere with other nearby electronic devices or sparks which could ignite the potentially explosive paint vapors. The expensive transducers and dispatchers are replaced with inexpensive solenoid valves, preferably proportional solenoid valves.

The paint spray apparatus includes a plurality of paint sprayers in a paint spray booth. Each paint sprayer includes a movable paint spray arm controlled by a plurality of servo motors. A paint spray head pivots on the outer end of the paint spray arm controlled by a servo motor. Paint is supplied to the paint spray head by a servo motor-driven paint spray pump or solenoid valve.

Each servo motor is controlled by a servo drive mounted in a paint sprayer panel installed on or beside the paint sprayer. A power supply is mounted in the paint sprayer panel and provides power to the servo drives. Because the paint sprayer panels are on or near the paint sprayer, the servo drives are connected to the servo motors by short, fixed-length cables rather than by cables of varying length up to 50 meters. Further, if the paint sprayer panels are mounted on the paint sprayers, the wires can be sized and connected during manufacture rather than during installation, thereby reducing the cost of assembly and increasing control over quality.

Each paint sprayer includes a plurality of limit switches for each axis which provide feedback signals to the servo drive when the paint spray arm is in predetermined positions. The limit switches are connected to the corresponding servo drive by cables which pass through intrinsic safety barriers which are mounted on the paint sprayer panel. The length of the cables is independent of the placement of the paint sprayers. Further, the cables require fewer connections and are shorter than the cables for the limit switches in the known paint spray apparatus. If the paint sprayer panel is mounted directly on the paint sprayer, these cables are connected during manufacture of the paint sprayer rather than installation of the paint spray apparatus, further reducing installation time and cost.

Each paint sprayer further includes a plurality of solenoid valves for controlling the rotary bell paint spray head. Each paint sprayer includes a bell speed solenoid valve, a brake solenoid valve, and a shaping solenoid valve. The paint sprayers may also include a paint supply solenoid valve as a low-cost alternative to the metering pump and pump servo motor. Each solenoid valve is controlled by one of the servo drives. The servo drive provides the input/output to the optical fiber, sends control signals to the solenoid valve and receives a feedback signal from the paint spray head while also controlling one of the servo motors.

The paint spray apparatus is controlled by a paint spray booth controller having a microprocessor connected to one or more motion cards by a bus. The motion cards include a microprocessor and memory containing, for each vehicle body type, information indicating the motion of the paint sprayers over the cycle, the desired shape and speed of the rotary bell paint spray head over the cycle, and paint flow over the cycle. The motion cards each include an input/output interface to an optical fiber to send signals to the servo drives. The controller further includes a connection to a monitor and keyboard for providing input and output to an operator.

In operation, the operator inputs data to the controller indicating the make and model of the vehicle body to be painted and the color paint to be sprayed. The motion cards then coordinate the timing, movement, and spray of the paint sprayers for the rest of the painting cycle (one vehicle body).

The motion cards send commands to the servo drives along the optical fiber using high-speed serial communication. Each servo drive follows commands from only one motion card and each motion card sends commands to a plurality of servo drives. Since only one node can send signals on the optical fiber at one time, the motion cards, servo drives and optical fiber preferably operate as a token ring network in which the motion cards are master nodes and the servo drives are slave nodes. The master motion cards take turns sending commands to their slave servo drives by receiving and passing on the right to send commands on the network ("the token"). Only the master motion card having the token sends commands to each of its slave servo drives, one at a time, in "command packets."

BRIEF DESCRIPTION OF THE DRAWINGS

The above, as well as other advantages of the present invention, will become readily apparent to those skilled in the art from the following detailed description of a preferred embodiment when considered in light of the accompanying drawings in which.

DETAILED DESCRIPTION OF THE PREFERRED EMBODIMENT

Figure 1:
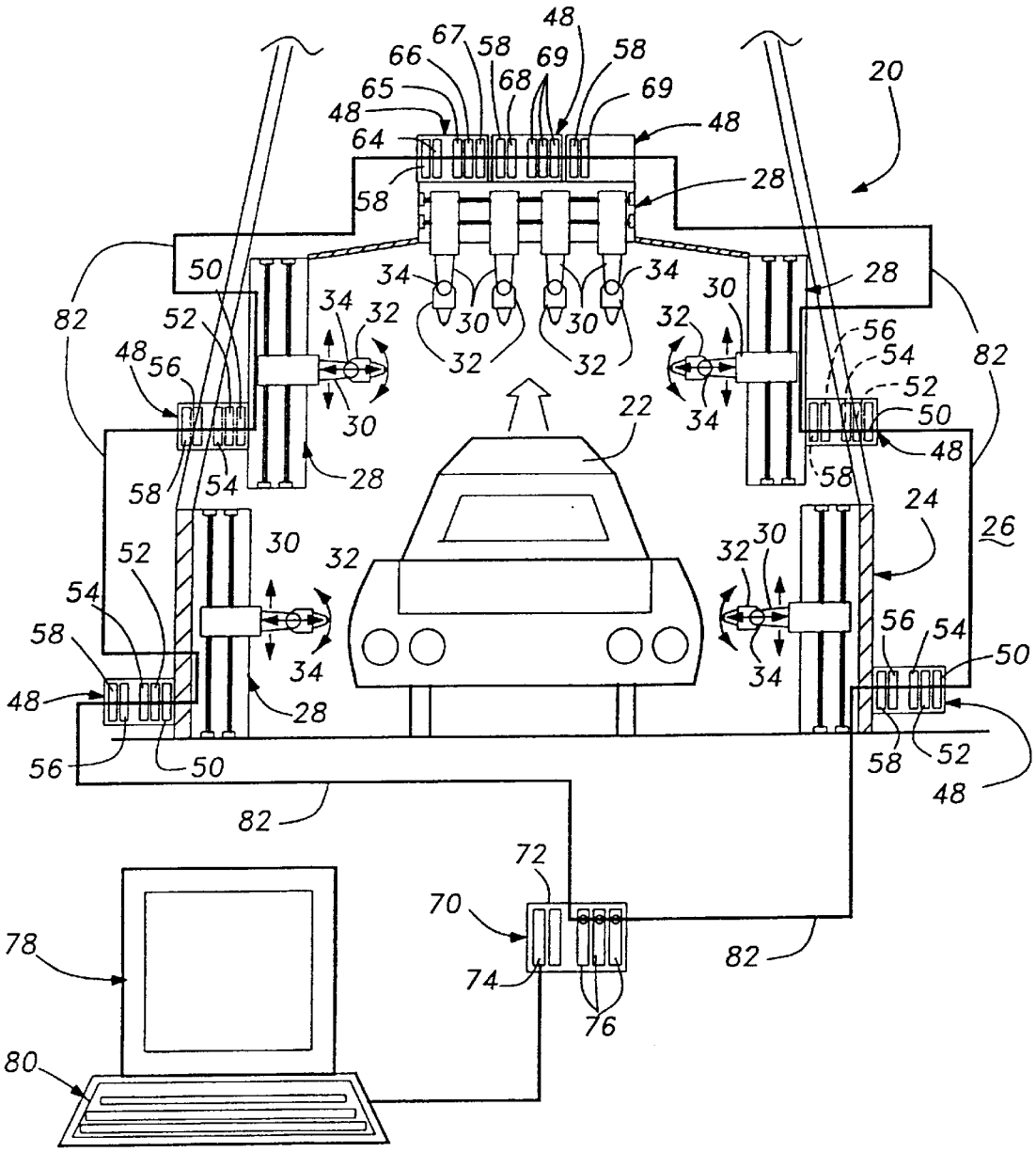
FIG. 1 is a perspective view of the paint spray apparatus of the present invention.

A paint spray apparatus 20 for painting a succession of articles such as vehicle bodies 22 is shown in FIG. 1. The paint spray apparatus 20 includes a paint spray booth 24 installed in a clean room 26. A plurality of paint sprayers 28 in the paint spray booth 24 each include a movable paint spray arm 30 and a paint spray head 32 on the outer end 34 of the paint spray arm 30. The paint spray head 32 is preferably a rotary bell atomizer, but other paint spray heads can be used. The paint spray arm 30 is movable vertically and extends and retracts horizontally. The paint spray head 32 pivots on the outer end 34 of the paint spray arm 30.

A paint sprayer panel 48 is mounted on each paint sprayer 28, preferably inside the clean room 26 but outside the paint spray booth 24. Alternatively, the paint sprayer panel 48 can be mounted adjacent each paint sprayer 28, outside the paint spray booth 24. The paint sprayer panel 48 is preferably a rack for receiving rack-mountable electronic devices. A rack-mountable vertical axis servo drive 50 is slidably mounted in the paint sprayer panel 48. The vertical axis servo drive 50 controls the direction and speed of the vertical axis motion of the paint spray arm 30. Similarly, a rack-mounted horizontal axis servo drive 52 controls the horizontal extension of the paint spray arm 30. A rack-mounted tilt axis servo drive 54 controls the tilt of the paint spray head 32 on the outer end 34 of the paint spray arm 30. A rack-mounted pump servo drive 56 in the paint sprayer panel 48 precisely controls the amount of paint supplied to the paint spray head 32. A rack-mounted power supply 58 is slidably mounted in the paint sprayer panel 48 and provides power to the servo drives 50, 52, 54, 56. The servo drives 50, 52, 54, 56 include an interface for input and output on an optical fiber and are commercially available from Kollmorgen Motion Technologies.

It should be apparent that the paint spray apparatus 20 may also include paint sprayers having fewer or greater number of axes and a corresponding number of servo drives. For example, a nine-axis overhead sprayer 59 includes a horizontal beam 60 having four paint spray heads 62. The overhead paint sprayer 59 preferably includes three paint sprayer panels 48 mounted outside the spray booth 24. Each paint sprayer panel 48 can receive a power supply 58 and up to four servo drives. Travel across the paint spray booth 24 in the direction of travel of the vehicle body 22 by the overhead paint sprayer 59 is controlled by a travel servo drive 64. Vertical movement of the horizontal beam 60 is controlled by a vertical axis servo drive 65. Rotation of the horizontal beam 60 is controlled by a pivot servo drive 66. The paint spray heads 62 move together horizontally as controlled by an oscillation servo drive 67. The spacing of the paint spray heads 62 on the horizontal beam 60 is controlled by an indexing servo drive 68. The flow of paint to each of the four paint spray heads 62 is controlled by a pump servo drive 69. Each of the nine servo drives 64, 65, 66, 67, 68, 69 on the overhead paint sprayer is slidably inserted in one of the paint sprayer panels 48 and precisely controls the current and voltage to a servo motor (not shown).

The paint spray apparatus 20 is controlled by a paint spray booth controller 70 including a panel 72 for mounting rack-mountable electronic devices. The panel 72 is preferably a VME rack including a microprocessor 74 and one or more motion cards 76. The motion cards 76 include an input/output interface for an optical fiber and are commercially available from Delta Tau Data Systems, Inc.. The motion cards 76 each include a microprocessor and a memory containing a sequence of commands for controlling a plurality of servo drives through a complete cycle of painting a vehicle body. The memory preferably contains a sequence of commands for each of several different vehicle body types to be painted. The controller 70 further includes a connection to a monitor 78 and keyboard 80 for providing input and output to an operator. An optical fiber 82 connects the motion cards 76 and all the servo drives 50, 52, 54, 56, 64, 65, 66, 67, 68, 69 in series preferably in a single ring.

Figure 2:
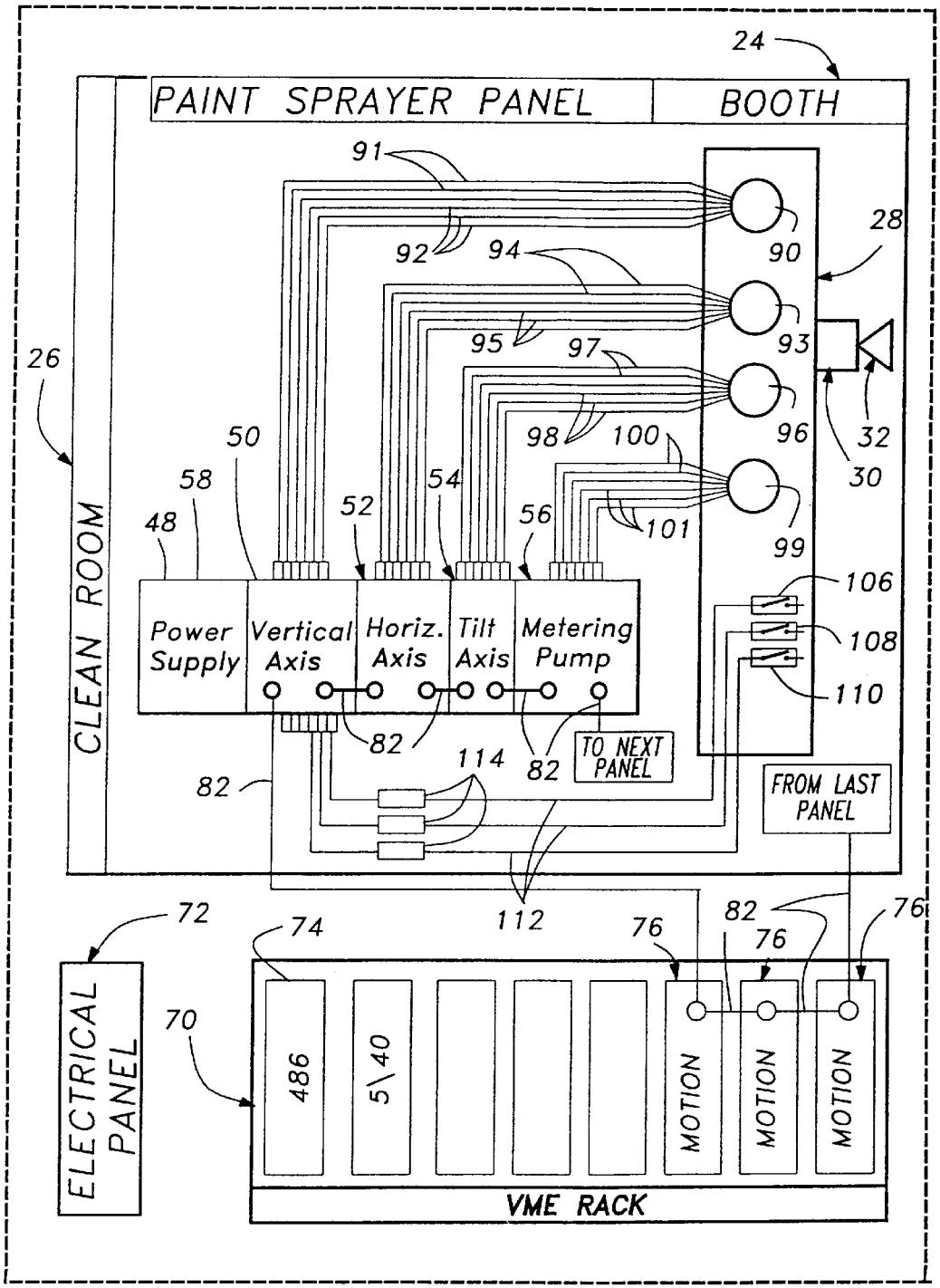
FIG. 2 is a schematic of the paint spray booth controller and one paint sprayer of FIG. 1.

Referring to FIG. 2, the vertical motion of the paint spray arm 30 is provided by a vertical axis servo motor 90 mounted in the paint sprayer 28. The vertical axis servo drive 50 controls the direction and speed of the vertical axis servo motor 90 by precisely varying the voltage and current along cables 91. The vertical axis servo drive 50 also receives a feedback signal along cables 92 from the vertical axis servo motor 90 indicating the relative vertical position of the paint spray arm 30.

The horizontal extension and retraction of the paint spray arm 30 is provided by a horizontal axis servo motor 93 mounted in the paint sprayer 28. The horizontal axis servo drive 52 controls the extension and retraction of the paint spray arm 30 by precisely varying the voltage and current along cables 94 supplied to the horizontal axis servo motor 93 while monitoring a feedback signal from the servo motor 93 along cables 95.

Further, the tilt of the paint spray head 32 on the outer end 34 of the paint spray arm 30 is provided by a tilt axis servo motor 96. The tilt axis servo drive 54 controls the tilt of the paint spray head 32 by precisely varying the current end voltage supplied to the servo motor 96 on cables 97 and monitoring a feedback signal from the servo motor 96 on cables 98.

The supply of paint to the paint spray head 32 is controlled by a paint pump driven by a pump servo motor 99. The pump servo drive 56 precisely controls the amount of paint supplied to the paint spray head 32 by varying the current and voltage supplied along cables 100 to the paint pump servo motor 99 while monitoring a feedback signal on cables 101.

It should be apparent that since the paint sprayer panel 48 is mounted on or adjacent the paint sprayer 28, the cables 91, 92, 94, 95, 97, 98, 100, 101 will be much shorter than in the known paint spray apparati and they will be the same length in each paint sprayer 28 independent of the location of the paint sprayer 28 or the distance between the paint sprayer 28 and the paint spray booth controller 70. If the paint sprayer panel 48 is mounted on the paint sprayer 28, these cables are connected to the panel 48 and the servo motors 90, 93, 96 99 during manufacture of the paint sprayer 28 rather than during installation of the paint spray apparatus 20.

Each paint sprayer 28 further includes two overtravel limit switches 106, 108 and a home limit switch 110 for each axis (one set shown). For example, the paint sprayers 28 include an upper overtravel limit switch 106 which provides a feedback signal to the vertical axis servo drive 50 when the paint spray arm 30 is in the extreme upper position. A home limit switch 108 provides a feedback signal to the vertical axis servo drive 50 when the paint spray arm 30 is in a home position. A lower overtravel limit switch 110 provides a feedback signal to the vertical axis servo drive 50 when the paint spray arm 30 is in the extreme lower position. The limit switches 106, 108, 110 are connected to the vertical axis servo drive 50 by cables 112 which pass through intrinsic safety barriers 114 mounted on the paint sprayer 28. Again, it should be apparent that the cables 112 will be of constant length independent of the placement of the paint sprayers 28. Further, if the paint sprayer panel 48 is mounted on the paint sprayer 28, the cables 112 can be connected between the limit switches for each of the axes to the paint sprayer panel 48 during manufacture of the paint sprayer 28 and before installation of the paint spray apparatus 20.

Figure 2A:
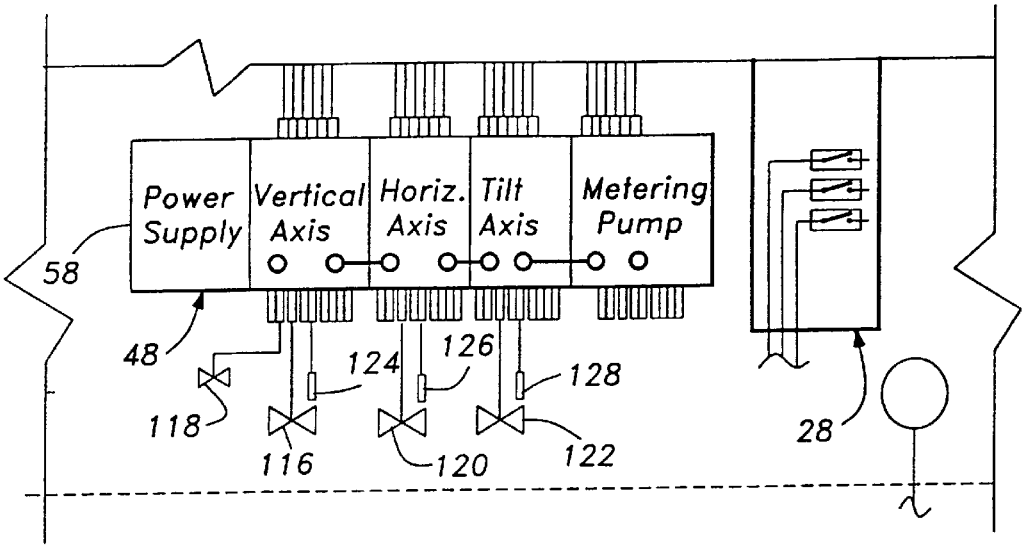
FIG. 2A is a schematic of the solenoid valve circuits of the paint spray booth controller of FIG. 2.

Referring to FIG. 2A, each paint sprayer 28 further includes a bell speed solenoid valve 116, a brake solenoid valve 118, and a shaping solenoid valve 120. The paint sprayers may also include a paint supply solenoid valve 122 instead of the metering pump and pump servo motor 99. The solenoid valves 116, 118, 120, 122 are preferably proportional solenoid valves controllable by an electrical signal. The bell speed solenoid valve 116 controls rotation speed of the rotary bell paint spray head 32. The brake solenoid valve 118 selectively slows or stops the rotation of the rotary bell paint spray head 32. The bell speed solenoid valve 116 and brake solenoid valve 118 received information from one of the servo drives, such as the vertical axis servo drive 50. The vertical axis servo drive 50 provides the input/output to the optical fiber 82, sends a control signal to the solenoid valves 116, 118 and receives a feedback signal 124 indicating the speed of the paint spray head 32. The horizontal axis servo drive 52 sends a control signal to the shaping solenoid valve 120 to control the shape of paint spray from the paint spray head 32 and receives a feedback signal 126. The tilt axis servo drive 54 similarly controls the optional paint supply solenoid valve 120 and receives a feedback signal 128.

The motion cards 76 send commands to the servo drives 50, 52, 54, 56 along the optical fiber 82 using high-speed serial communication. The motion cards 76, and servo drives preferably communicate using MACRO Multi Master, a published non-proprietary token ring network communication standard developed by Delta Tau Data Systems for Behr System. The motion cards 76 are master nodes and the servo drives 50, 52, 54, 56 are slave nodes. Each servo drive (slave node) follows commands from only one motion card 76 (master node), and each motion card 76 sends commands to a plurality of servo drives. The servo drives also provide feedback signals to the motion cards 76. Because only one node can send signals on the optical fiber 82 at one time, the nodes (master motion cards 76 and slave servo drives) preferably operate as a token ring network. The master motion cards 76 take turns sending commands to their slave servo drives by sequentially receiving and passing on the right to send commands on the network ("the token"). Only the master motion card 76 having the token sends commands to each of its slave servo drives, one at a time, in "command packets." Each command packet includes an identification signal, which can be one byte. It is anticipated that the identification byte would include four bits which identify the master motion card 76 and four bits which identify the slave servo drive. This would permit sixteen master motion cards 76 each having sixteen slave servo drives.

In the present paint spray apparatus 20, one motion card 76 (master) first sends a command packet for one of its slave servo drives. The command packet travels through the optical fiber 82, passing through the other master motion cards 76 and the slave servo drives, which analyze the identification byte. The command packet is ignored by the other master and slave nodes that do not correspond to the identification byte. Only the slave node identified by the identifying byte latches on to the command packet. The slave servo drive then adjusts the speed and direction of the motor it controls in accordance with the command packet. The slave servo drive also substitutes a feedback packet for the command packet. The feedback packet passes through the master and slave nodes for which they are not intended and is latched by the master motion card 76. Then the master motion card 76 communicates with each of its other slave servo drives in sequence. After the master motion card 76 communicates with its last slave servo drive, the motion card 76 "passes the token" to the next master motion card 76 by sending a signal on the optical fiber 82, thereby indicating that the next master motion card 76 can send command packets on the optical fiber 82.

Figure 3:
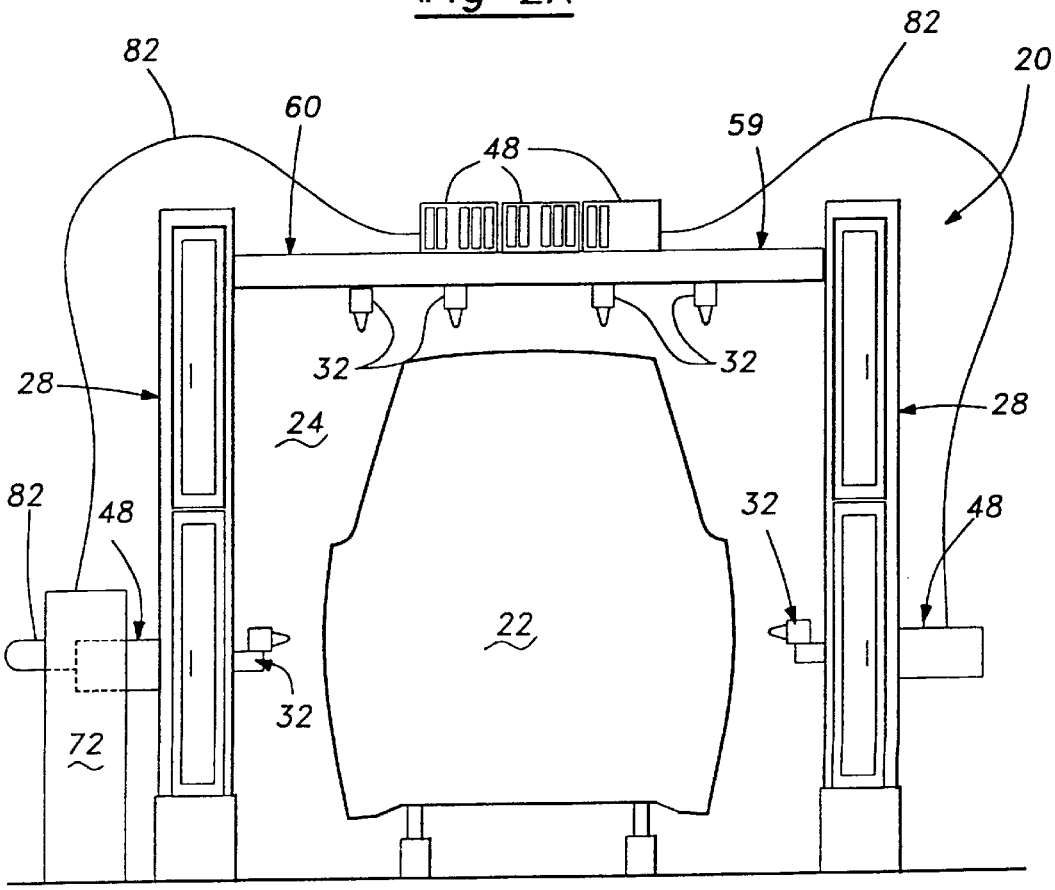
FIG. 3 is a front view of the paint spray apparatus of FIG. 1

Referring to FIG. 3, installation is greatly simplified in that the paint sprayers 28 are largely prewired. The paint sprayer panels 48 are located outside the paint spray booth 24, but are mounted on or adjacent the paint sprayers 28, 59. At installation, only the optical fiber 82 is connected to each of the paint sprayers 28 and to the motion cards 76. Further, the amount of wire and connectors is greatly decreased, thereby both decreasing the cost and increasing the reliability of the paint spray apparatus 20. Further, the optical fiber 82 does not carry electrical current and therefore does not generate electromagnetic fields which interfere with other nearby electronic devices or provide a spark which could ignite the potentially explosive paint vapors.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for installing a paint spray booth including the steps of:

a) installing at least one network interface on each of a plurality of paint sprayers, each said paint sprayer including a paint spray head for spraying paint;

b) installing said plurality of paint sprayers adjacent a paint spray booth after said step a);

c) connecting said plurality of said network interfaces of said plurality of paint sprayers in a network after said step b);

d) mounting a motor controller for generating a control signal in each said paint sprayer before said step b);

e) connecting said motor controller to said network interface before said step b);

f) mounting a motor to move said spray head on each said paint sprayer before said step b); and g) connecting said motor to said motor controller to receive said control signal before said step b).

2. The method of claim 1 further including the step of:

h) mounting a plurality of motor controllers and motors according to said steps d–g) in each said paint sprayer; and i) installing one network interface for each of said motor controllers in each said paint sprayer in said step a).

3. The method of claim 1 further including the step of:

connecting the network interfaces in series in said step c).

4. The method of claim 3 wherein said step c) further includes the step of connecting the plurality of network interfaces in a token ring network, forming a node in the token ring network at each said network interface.

5. The method of claim 1 wherein said motor controller is a servo drive.

6. The method of claim 1 further including the step of:

connecting the network interfaces in series in said step c).

7. The method of claim 6 wherein said step c) includes the step of connecting said network interfaces by optical fiber.

8. The method of claim 7 wherein said step c) further includes the step of connecting the plurality of network interfaces in a token ring network, forming a node in the token ring network at each said network interface.

9. A paint sprayer including:

a paint spray head for spraying paint;

a network communication interface mounted on said paint sprayer, said network communication interface capable of forming a node on a network and receiving information, said paint spray head operable to spray paint based upon said information received from said network communication interface; and at least one motor controller mounted on said paint sprayer generating a control signal based upon said information.

10. The paint sprayer of claim 9 further including:

at least one motor mounted on said paint sprayer, said motor receiving said control signal from one of said at least one motor controller and moving said spray head based upon said control signal.

11. The paint sprayer of claim 10 wherein said at least one motor controller includes a plurality of motor controllers connected in series for communication, said at least one motor comprising a plurality of motors, each of said plurality of motor controllers sending control signals to an associated one of said plurality of motors.

12. The paint sprayer of claim 11 wherein said communication interface comprises a plurality of communication interfaces each capable of forming a node on the network and receiving information, each of said plurality of motor controllers receiving said information via one of said plurality of communication interfaces.

13. The paint sprayer of claim 10 wherein said at least one motor moves said paint spray head based upon said control signal.

14. The paint sprayer of claim 10 further including at least one solenoid valve controlling a supply of a liquid in said paint sprayer, said solenoid valve opening and closing based upon said information.

15. The paint sprayer of claim 10 wherein said motor controller is a servo drive.

16. A paint sprayer including:

a paint spray head for spraying paint;

a network communication interface mounted on said paint sprayer, said network communication interface capable of forming a node on a network and receiving information, said paint spray head operable to spray paint based upon said information received from said network communication interface, wherein said communication interface includes a connector for connection to an optical fiber, said communication interface receiving said information via said connector.

17. A paint sprayer including:

a paint spray head for spraying paint;

a network communication interface mounted on said paint sprayer, said network communication interface capable of forming a node on a network and receiving information, said paint spray head operable to spray paint based upon said information received from said network communication interface, wherein said communication interface is programmed to operate as a node in a token ring network.

18. A paint sprayer including:

a paint spray head for spraying paint;

at least one network communication interface mounted on said paint sprayer, said network communication interface programmed to form a node on a network and receiving information via the network;

a plurality of motor controllers mounted on said paint sprayer each generating a control signal based upon said information; and a plurality of motors mounted on said paint sprayer, each said motor receiving one of said control signals from an associated one of said plurality of motor controllers and moving said spray head based upon said one of said control signals.

19. The paint sprayer of claim 18 wherein said at least one communication interface comprises a plurality of communication interfaces each associated with one of said motor controllers, each communication interface capable of forming a node on the network and receiving information, each of said plurality of motor controllers receiving said information via an associated one of said plurality of communication interfaces.

20. The paint sprayer of claim 19 wherein said plurality of motor controllers are connected in series with each other for communication.

21. The paint sprayer of claim 20 wherein said communication interface includes a connector for connection to an optical fiber, said communication interface receiving said information via said connector.

22. The paint sprayer of claim 21 wherein said communication interface is programmed to operate as a node in a token ring network.

23. The paint sprayer of claim 18 wherein said motor controllers are servo drives.

* * * * *